United States Patent [19]

Wilkerson

[11] Patent Number: 4,577,822

[45] Date of Patent: Mar. 25, 1986

[54] BACKING FOR A PHOTO OR PICTURE FRAME

[75] Inventor: David T. Wilkerson, Pinner, England

[73] Assignee: Masters Wilkerson Manufacturing Co. Ltd., London, England

[21] Appl. No.: 490,896

[22] Filed: May 2, 1983

[30] Foreign Application Priority Data

May 11, 1982 [GB] United Kingdom ..... 8213661

[51] Int. Cl.[4] ..... A47B 97/08

[52] U.S. Cl. ..... 248/463; 248/455; 248/558

[58] Field of Search ..... 248/544, 460, 463, 465, 248/558, 455, 496; 40/154, 155

[56] References Cited

U.S. PATENT DOCUMENTS

| | | | |
|---|---|---|---|
| 1,177,233 | 3/1916 | Cutler | 248/460 |
| 1,762,083 | 6/1929 | Singer, Jr. | 40/154 |
| 2,958,490 | 11/1960 | Johnson | 248/460 |

FOREIGN PATENT DOCUMENTS

| | | | |
|---|---|---|---|
| 1528065 | 4/1968 | France | 248/463 |
| 176079 | 2/1922 | United Kingdom | 248/460 |
| 1092799 | 11/1967 | United Kingdom . | |
| 1512380 | 6/1978 | United Kingdom . | |

*Primary Examiner*—Ramon S. Britts
*Assistant Examiner*—Karen Chotkowski
*Attorney, Agent, or Firm*—Biebel, French & Nauman

[57] ABSTRACT

A strut back for a photo or picture frame comprises a back having at least one slot shaped to define the boundary of a region of flexion and a strut having an integrally formed projecting lip or flange which can be engaged in said slot by flexing of said region such that said lip or flange embraces one edge of the slot and is urged against said edge when said frame is stood in a display position supported by the strut. Both the strut and the back may be moulded from a plastics material and the back may have an overall thickness to accommodate said portion of said lip or flange projecting through said slot.

6 Claims, 4 Drawing Figures

BACKING FOR A PHOTO OR PICTURE FRAME

The present invention relates to a backing for a photo or picture frame of the type in which the frame back is used in conjunction with or incorporates a strut by means of which the frame can be stood in a desired display position. Such a backing is known in the art as a strut back.

BACKGROUND OF THE INVENTION

Various methods have been proposed hitherto for attaching the strut to the back of the frame. In one long standing and simple method, the strut is attached to the back by means of a hinge and the angle of the strut relative to the back, which determines the attitude that the frame will take when stood in the display position, is regulated by means of a stay or cord extending between the back and the strut. Such a construction is cumbersome and expensive to produce and is only really suitable for large sizes of frame.

Another existing construction employs a strut which is riveted to the back, in such cases both the back and the strut are usually made of stout card or board. Such a construction is limited in its ability satisfactorily to support a frame in the desired position and is also relatively weak.

In yet another existing construction, the strut is provided adjacent its back-engaging end with a hook-shaped metal clip which clips over a metal bar or stirrup attached to the back of the frame. These metal parts are again generally riveted to the strut and the frame back, which are usually made of stout card or board or else of wood. Here again the mechanical construction is relatively expensive to produce and is readily damaged.

Moreover, since all of the existing prior art arrangements for attaching a strut to the back of a frame require separate fastening means such as hinges, rivets or clips, their production is labour-intensive and hence costly.

It is an object of the present invention to provide an improved construction of strut back for a photo or picture frame which is both simple and strong and does not require expensive labour operations for its assembly.

SUMMARY OF THE INVENTION

From one aspect, the present invention provides a back for a photo or picture frame in combination with a strut by means of which the frame can be supported in a display position wherein a region adjacent the back-engaging end of the strut is provided with a projecting lip or flange which can locate within a slot formed in the frame back such that, when the frame is stood in a display position supported by the strut, the lip or flange embraces one edge of the slot and is urged against said edge.

Preferably the slot is shaped to define part of the boundary of a region which can flex as the lip or flange is entered into or removed from the slot in order to facilitate assembly or dismantling of the strut from the back. For example, the slot may define three sides of a rectangular flexing region. This flexing region may be of reduced thickness adjacent its free edge to assist engagement and disengagement of the lip or flange with said edge of the slot.

The back-engaging end of the strut is preferably bevelled or chamfered, in which case the angle of the bevel or chamfer serves to determine the angle which the strut makes with the back when the frame is stood in a display position.

The back may be formed with a series of ribs or webs to give additional strength and which are dimensioned such that their depth serves to accommodate that part of the lip or flange projecting through the slot.

Preferably, both the strut and the back are made as mouldings of a synthetic plastics material having some degree of resilience, such as a styrene plastic, which may be a foamed styrene, or a material such as ABS.

From another aspect, therefore, the invention provides a strut back for a photo or picture frame comprising a back having at least one slot shaped to define the boundary of a region of flexion and a strut having an integrally formed projecting lip or flange which can be engaged in said slot by flexing of said region such that said lip or flange embraces one edge of the slot and is urged against said edge when said frame is stood in a display position supported by the strut, both said strut and said back being moulded from a plastics material and said back having an overall thickness to accommodate said portion of said lip or flange projecting through said slot.

The overall thickness of said back may include a strengthening web formation which is of sufficient depth to accommodate the lip or flange projecting through said slot.

As is well known in the art, in the case of rectangular photo or picture frames, it is often desired to provide a strut back such that the strut can be disposed in at least two positions, in one of which the frame is supported so as to have a generally vertical aspect and in another of which the frame is supported so as to have a generally horizontal aspect. To this end, the back may be provided with at least two slots if either or any of which the lip or flange on the strut can be engaged, whereby in at least one position of engagement an associated rectangular frame can be stood with a generally vertical aspect, and in at least another position of engagement the frame to be stood with a generally horizontal aspect.

BRIEF DESCRIPTION OF THE DRAWINGS

The invention will now be further described, by way of example, with reference to the accompanying drawings, in which.

DESCRIPTION OF THE PREFERRED EMBODIMENT

Figure 1:
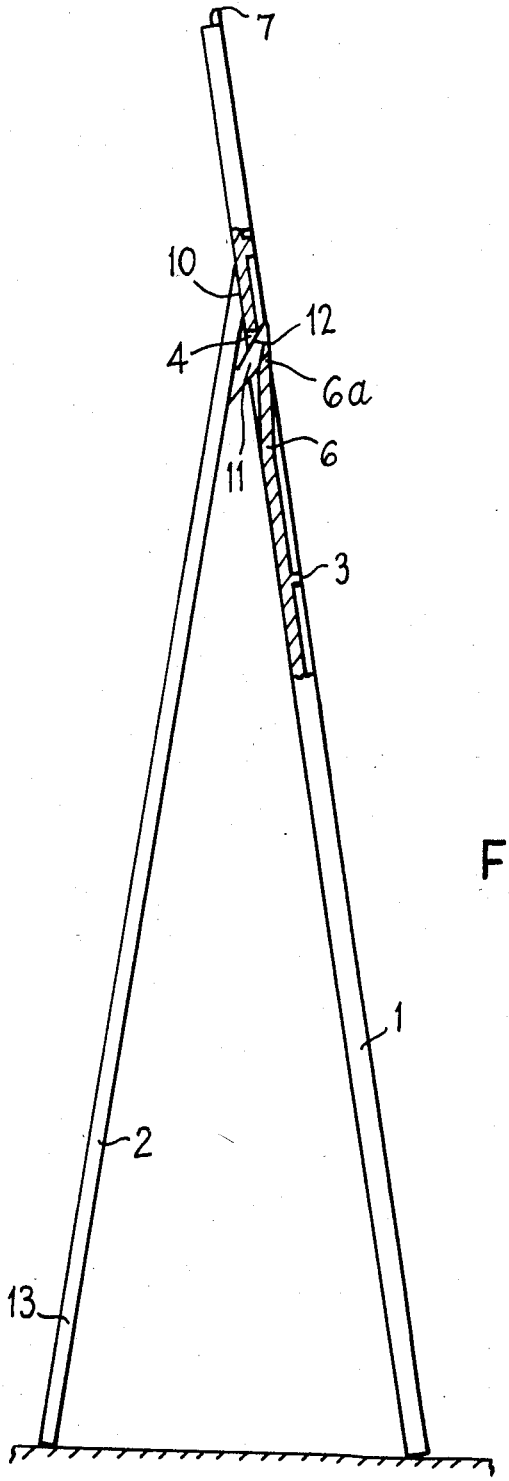
FIG. 1 is a side view, partly in section, of one embodiment of a strut back according to the invention.
Figure 3:
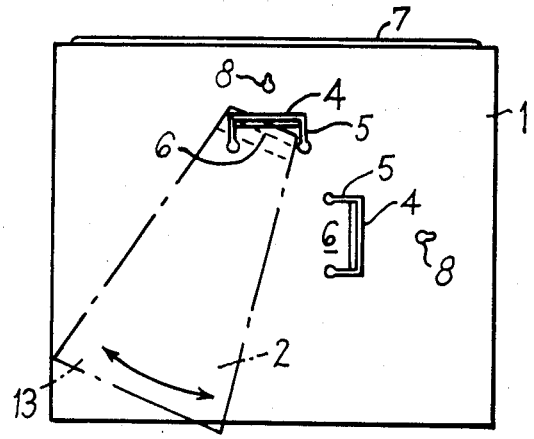
FIG. 3 is an explanatory plan view on a smaller scale of the strut back assembly viewed from its rear side.

Referring to the drawings the strut back illustrated is intended to form a backing which encloses the rear of a photo or picture frame and also provides a strut support by means of which the frame can be stood in a desired display position.

The strut back comprises two parts, namely a rectangular frame back 1 and a strut 2, both of which are mouldings made of a rigid but resilient synthetic plastics material, such as a rigid styrene or ABS.

The frame back 1 is of rectangular form and consists of a sheet-like member strengthened by series of ribs 3 forming both a peripheral edge and cross webs on the forward facing side of the back, i.e. the side to be located adjacent the rear of a photograph or picture mounted in the frame. The frame back is also formed with two slots, each of generally 'goal post' shape, comprising a central limb 4 and two dependent side limbs 5 terminating in small circular apertures. The two slots are disposed generally at right angles to each other, and the central limb 4 of each is parallel to a respective side of the frame. Each slot defines the boundary of a region 6 of the back which can flex and which as a thinner chamfered edge 6*a* facing the central limb 4. One side of the back 1 is also provided with a lip 7 to facilitate its engagement within the frame as well as with two keyhole apertures 8 by means of which a frame incorporating the back may be hung on a wall-hook or pin with either a generally vertical or generally horizontal aspect, when it is desired to use it in this way instead of using the strut 2 to support it standing on a surface as above described.

The strut 2 generally tapers from its lower end to its upper end and is provided with an inclined or bevelled upper edge 10 at its upper end which abuts the back. This bevelled edge 10 hence determines the angle of the strut to the back and therefore the stance of the frame when stood in the display position.

The strut is secured to the frame at the location of either one of the slots, depending upon whether it is desired that the frame shall stand with a generally vertical aspect or a generally horizontal aspect, and to this end is provided with an integrally moulded projecting lip or flange 11 which locates within the central limb 4 of the slot so that the upper edge of this central limb is embraced by the lip or flange 11. The forward facing side of the lip or flange is also provided with a forwardly projecting edge 12 which engages on the chamfered edge 6*a* facing the central limb 4 of the slot. As the lip or flange 11 is entered into the central limb 4 of the slot, the region bounded by the slot flexes to allow the two parts to interengage to the position shown in FIG. 1, with the bevelled edge 10 abutting the rear of the frame back 1, and the lip or flange 11 embracing the upper edge of the central limb 4 and the projecting edge 12 engaged over the chamfered edge 6*a*.

Figure 2:
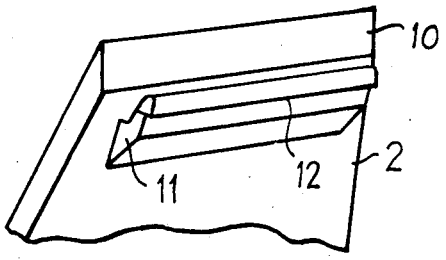
FIG. 2 is a perspective view of part of the strut.
Figure 4:
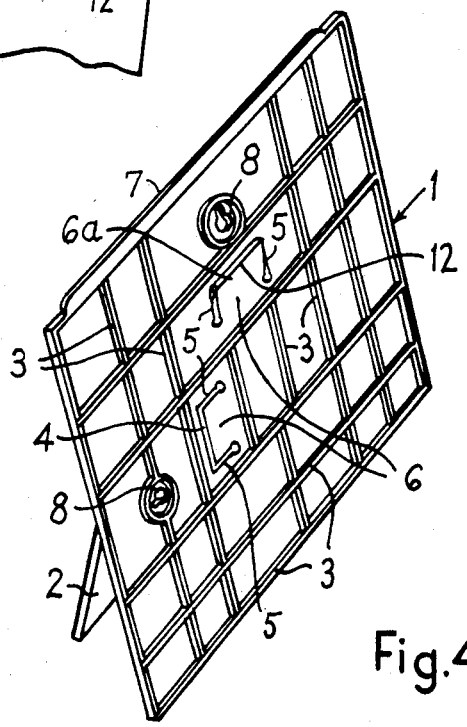
FIG. 4 is a perspective view on the same scale as FIG. 3 of the strut back viewed from the forward facing side.

When it is desired to remove the strut 2 from the back 1, the lower end 13 of the strut is merely swung to one side, as indicated in broken lines in FIG. 2, which causes one corner of the lip or flange 11 to pivot about a corner defined by slot limbs 4 and 5 and due to the flexing of the region 6, allows the projecting edge 12 to disengage from the chamfered edge 6*a* and the lip or flange 11 to be withdrawn from the slot.

It will be noted that, as shown in FIG. 1, in the assembled position the webs 3 are of sufficient depth to accommodate the part of the lip or flange 11 projecting through the slot 4 and the deflection of the region 6. Thus, the forward facing side of the back presents a constant level support surface, i.e. the tops of the webs 3, to the rear surface of a picture or photo mounted within the frame.

It will be seen that the present invention provides a simple, robust and inexpensive construction of strut back which is easy to produce and gives effective support to a picture or photo frame.

Whilst a particular embodiment has been described, it will be understood that various modifications may be made without departing from the scope of this invention. Thus the back may be of any desired shape or size depending on the frame with which is is to be used and may also be made of other plastics materials besides those given as examples. Also the projecting lip or flange and cooperating slot may have other configurations besides those illustrated.

I claim:

1. A back for a photo or picture frame in combination with a strut by means of which the frame can be supported in a display position, and wherein:

said back has at least one slot generally coplanar with the back and defining a substantial part of a boundary of a region which can flex relative to the remainder of said back, said strut has one end abutting said back, the abutting portion of said one end being inclined or bevelled, and an integrally formed lip or flange extending obliquely from said strut adjacent said one end and on the same thereof as said abutting portion, said lip or flange being engaged in said slot with one edge of said slot being embraced between said one end and said lip or flange, said engagement being affected by the inward flexing of said region, and a projection on said lip or flange engaging a second edge of said slot which second edge is an edge of said flexing region, said strut being disengageable from said back by swinging the strut across said back to cause said flexing region to flex and disengage said projection from said second edge and thereby release said lip or flange from said slot.

2. The combination as claimed in claim 1, in which the projection on said lip or flange is a projecting edge which engages on said second edge of said slot, said second edge being chamfered.

3. The combination as claimed in claim 1, in which the back is formed with a series of strengthening ribs or webs which are dimensioned such that the depth of the ribs or webs serves to accommodate that part of the lip or flange projecting through the slot.

4. The combination as claimed in claim 1, in which the slot defines three sides of a rectangular flexing region and in which said flexing region is of reduced thickness adjacent the second edge to assist engagement and disengagement of the projection on said lip or flange with said second edge of the slot.

5. A back for a photo or picture frame in combination with a strut by means of which the frame can be supported in a display position, and wherein:

said back is a moulded synthetic plastics member having at least one three-sided slot generally coplanar with the back and defining a substantial part of a boundary of a region which can flex relative to the remainder of said back, said strut is a moulded synthetic plastics member having one end abutting said back, the abutting portion of said one end being inclined or bevelled at an angle which determines the angle of the strut to the back when the frame is stood in a display position and an integrally formed lip or flange extending obliquely from said strut adjacent said one end and on the same side thereof as said abutting portion, said lip or flange being engaged in said slot with one edge of said slot being embraced between said one end and said lip or flange said engagement being affected by the inward flexing of said region, and a projecting edge on said lip or flange engaging on a second edge of said slot which second edge is a bevelled edge of said flexing region, said strut being disengageable from said back by swinging the strut across said back to cause said flexing region to flex and disengage said projecting edge from said second edge and thereby release said lip or flange from slot.

6. The combination as claimed in claim 5 in which said three-sided slot defines three sides of a rectangular flexing region and the ends of said slot terminate in circular apertures.

* * * * *